US008550557B2

(12) United States Patent
Bock

(10) Patent No.: US 8,550,557 B2
(45) Date of Patent: Oct. 8, 2013

(54) SYNCHRONOUS MECHANISM

(75) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 572 days.

(21) Appl. No.: 12/779,351

(22) Filed: May 13, 2010

(65) Prior Publication Data

US 2010/0295351 A1 Nov. 25, 2010

(30) Foreign Application Priority Data

May 13, 2009 (DE) ..... 10 2009 021 193

(51) Int. Cl.
*A47C 1/032* (2006.01)
*A47C 3/00* (2006.01)

(52) U.S. Cl.
USPC ..... 297/320; 297/300.1

(58) Field of Classification Search
USPC ..... 297/300.2–300.7, 300.1, 320, 322
See application file for complete search history.

(56) References Cited

U.S. PATENT DOCUMENTS

| | | | | |
|---|---|---|---|---|
| 5,826,940 | A * | 10/1998 | Hodgdon | 297/303.1 |
| 6,238,000 | B1 | 5/2001 | Hallmark et al. | |
| 6,709,058 | B1 * | 3/2004 | Diffrient | 297/320 |
| 6,886,888 | B2 * | 5/2005 | Bock | 297/300.2 |
| 6,923,503 | B2 * | 8/2005 | Sangiorgio | 297/342 |
| 7,478,880 | B2 * | 1/2009 | Johnson et al. | 297/342 |
| 7,600,814 | B2 * | 10/2009 | Link | 297/300.2 |
| 2002/0171276 | A1 | 11/2002 | Bock | |

FOREIGN PATENT DOCUMENTS

| | | | |
|---|---|---|---|
| AT | 405124 | B | 5/1999 |
| DE | 4208648 | C1 | 5/1993 |
| DE | 19607136 | A1 * | 8/1996 |
| DE | 19810768 | A1 | 9/1999 |
| DE | 202007001395 | U1 | 6/2008 |
| EP | 0561059 | B1 | 7/1996 |
| EP | 0934716 | A2 | 8/1999 |
| EP | 1258210 | A2 | 11/2002 |
| JP | 2001128786 | A | 5/2001 |

* cited by examiner

*Primary Examiner* — David Dunn
*Assistant Examiner* — Tania Abraham
(74) *Attorney, Agent, or Firm* — Laurence A. Greenberg; Werner H. Stemer; Ralph E. Locher

(57) ABSTRACT

The invention relates to a synchronizing mechanism for a correlated seat-backrest movement of an office chair, said mechanism including a base support (1) that can be placed on a chair column, a seat support (3) and a backrest support (4). In order to provide a synchronizing mechanism, by means of which a high level of seating comfort can be achieved in an inexpensive manner, a mechanism is proposed where the backrest support (4) is connected to the base support (3) so as to be pivotable about a transverse axis (8) and has an entrainment means (9) that is in operative connection with the seat support (3) in such a manner that when the backrest carries out a pivoting movement (6) backward, the seat support (3) also performs a movement (13) backward.

6 Claims, 5 Drawing Sheets

SYNCHRONOUS MECHANISM

BACKGROUND OF THE INVENTION

Field of the Invention

The invention relates to a synchronizing mechanism for a correlated seat-backrest movement of an office chair, said mechanism including a base support that can be placed on a chair column, a seat support and a backrest support.

The term "synchronizing mechanism" refers to component assemblies in the substructure of an office chair that provide for interconnected kinematics that bring about a certain relative movement between seat and backrest one relative to the other. The seat of the office chair, as a rule provided with a cushioned sitting surface, is mounted on the seat support. The backrest support, which is conventionally extended backward by the actual synchronizing mechanism, supports the backrest of the office chair on an upwardly extending extension. Seat support and backrest support are usually coupled in a pivoting manner in such a manner that a pivoting movement of the backrest backward—as can be produced, for example, by the user of the chair leaning back against the back rest—induces a lowering movement of the rear edge of the seat. This is to prevent the so-called "pulling-out-shirt effect" and to increase the comfort of the seat. These types of synchronizing mechanisms are often constructed in a very complex manner and are consequently expensive to produce.

Over and above this "asynchronous mechanisms" are also known. This refers to such component assemblies where a pivoting of the backrest does not induce any movement of the seat support. In other words, when there is a pivoting movement backward, only the backrest moves. The comfort of the seat is greatly reduced compared to synchronizing mechanisms. In particular in the case of asynchronous mechanisms, the so-called "pulling-out-shirt effect" occurs on account of a "divergence" of the movements of backrest and seat. However, such component assemblies are clearly less expensive to produce than the afore-described synchronizing mechanisms on account of their comparatively simple design.

BRIEF SUMMARY OF THE INVENTION

It is the object of the present invention to provide a mechanism for an office chair, by means of which mechanism increased seating comfort can be achieved in an inexpensive manner.

This object is achieved by a synchronizing mechanism as claimed.

As claimed in the present invention, it is provided that the backrest support is connected to the base support so as to be pivotable about a transverse axis and has an entrainment means that is in operative connection with the seat support in such a manner that when the backrest carries out a pivoting movement backward, the seat support also performs a movement backward.

A fundamental idea of the invention, consequently, is to take the concept of a synchronizing mechanism, to bring about a certain relative movement between seat and backrest one relative to the other, and to develop it in such a manner that comparable seating comfort is possible without a complicated structure. The following of the seat in the direction of the backrest that is necessary to avoid the "pulling-out-shirt effect" is achieved according to the invention in that the seat support is pulled backward by an entrainment means that is located on the backrest support. In this case, the pivotal point of the backrest defined by the position of the transverse axis is matched to the pulling direction of the seat backward and to the length of the pulling movement. When there is a pivoting movement backward, the body of the user consequently follows the backrest in a defined manner. Through the entraining of the seat, a "divergence" of the movements of backrest and seat and consequently the "pulling-out-shirt effect" are avoided as far as possible, which means that the seating comfort is comparable with the seating comfort of a conventional synchronizing mechanism.

At the same time, the proposed synchronizing mechanism is designed almost as simply as an asynchronous mechanism, thereby making particularly good value production possible.

According to the invention, a pivoting mechanism is proposed that is structurally comparatively simpler compared to the solutions known from the prior art, by way of which mechanism the so-called "pulling-out-shirt effect" is clearly reduced. A particularly higher level of seating comfort is achieved without having to resort to more complicated and expensive solutions.

Particularly advantageous is an embodiment of the invention where the entrainment means engages the seat support in a direct or indirect manner. In other words, there is no need for any complicated structures to actuate the seat support, such as lifting mechanisms etc., by means of which seat and base support and backrest support are linked together using different pivotal points and various cam tracks. Instead of these, one single entrainment means on the backrest support is sufficient to achieve the desired movement of the seat support.

BRIEF DESCRIPTION OF SEVERAL VIEWS OF THE DRAWING

Further advantageous embodiments of the invention are provided in the subclaims and are described below in conjunction with an exemplary embodiment of the invention by way of the drawings, in which, in detail:

DESCRIPTION OF THE INVENTION

All figures just show the synchronizing mechanism in a schematic manner with the components that are essential to the invention. Identical references in this case correspond to elements with the identical or comparable function.

Figure 1:
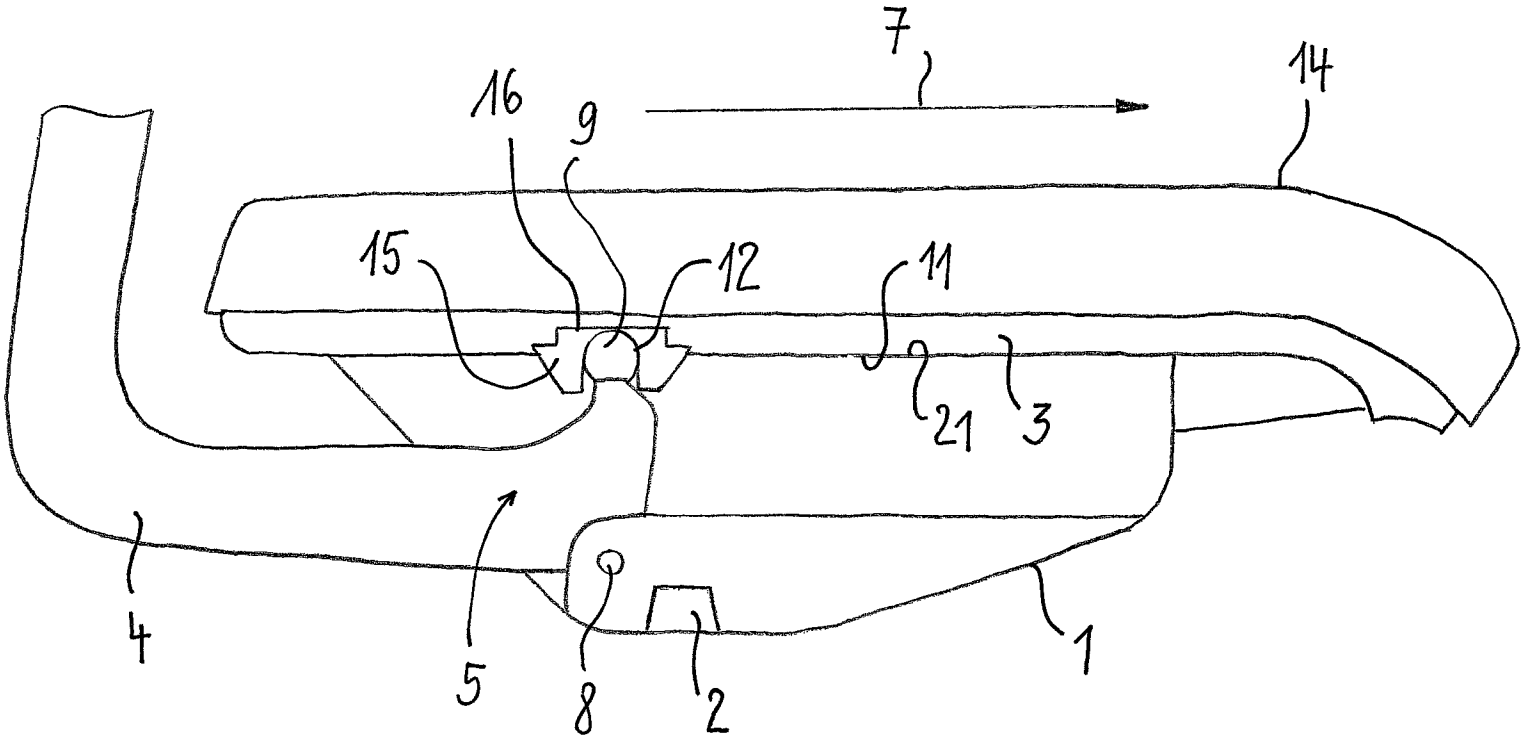
FIG. 1 shows a side view of the synchronizing mechanism in the initial position.

The synchronizing mechanism in the figures has a base support 1, which is fitted onto the top end of a chair column (not shown) by means of a cone accommodating means 2, see FIG. 1. Over and above this, the synchronizing mechanism includes a substantially frame-shaped seat support 3 and, when viewed in top view, a fork-shaped backrest support 4, the bearers 5 of which are located on both sides of the base support 1. The seat support 3 is provided for accommodating or mounting a cushioned sitting surface. Mounting is effected by means of securing elements (not shown in any detail) in the usual manner. A backrest (not shown in any detail) is attached to the backrest support 4, said backrest support being vertically adjustable in the case of modern office chairs. The backrest can also be integrally connected to the backrest support 4.

The entire synchronizing mechanism is designed in a mirror-symmetrical manner with regard to a central longitudinal axis, which pertains to the actual kinematics. In this respect, it must always be assumed in the following description that the structural elements of the actual pivoting mechanism are present in pairs on both sides.

Figure 2:
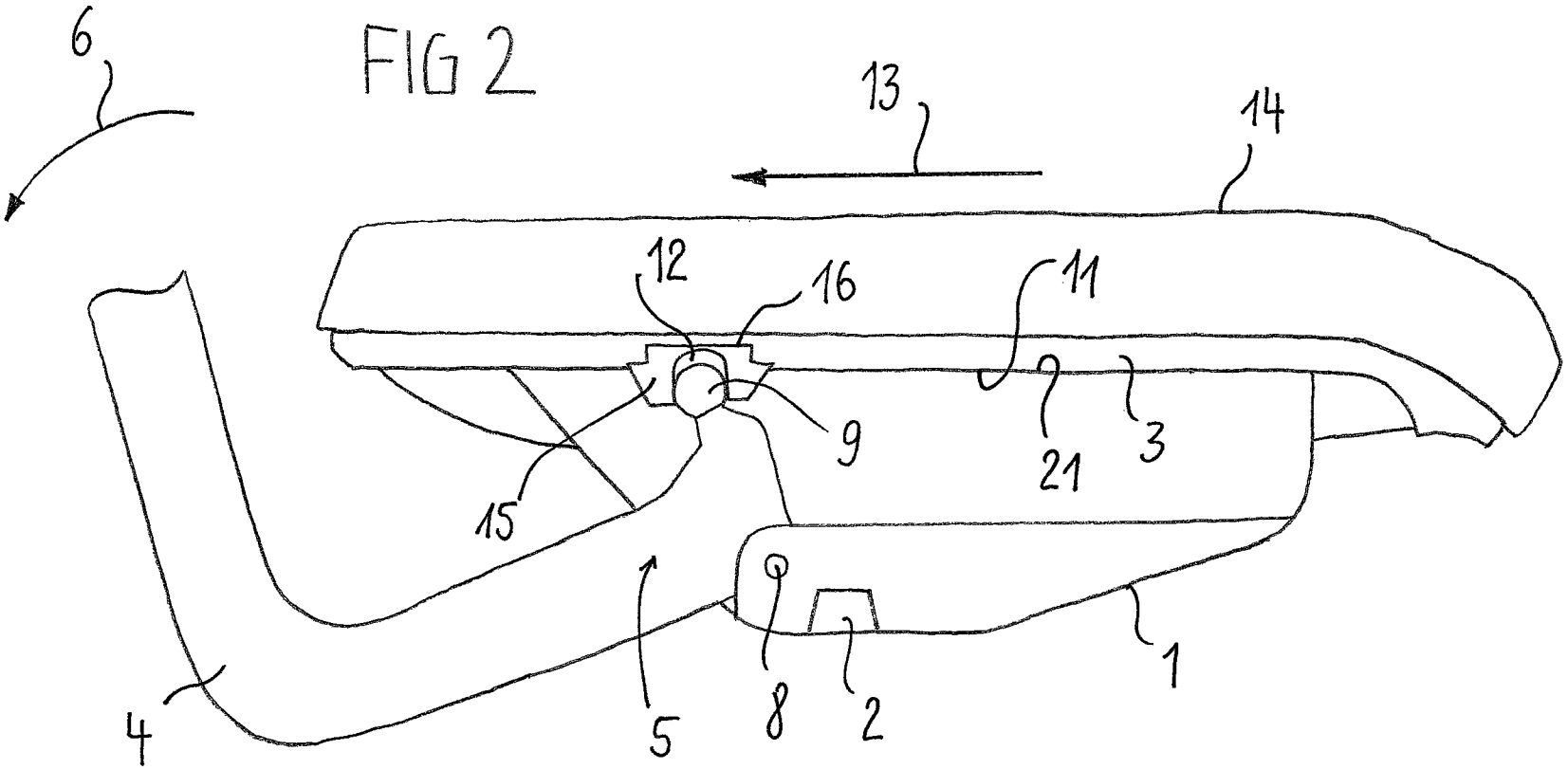
FIG. 2 shows a side view of the synchronizing mechanism in a position pivoted backward.

FIG. 1 shows the initial position at which the backrest support 4 assumes a substantially perpendicular position. FIG. 2 shows the synchronizing mechanism in a position pivoted backward.

The backrest support 4 that is pivotable in the pivoting direction 6 is connected to the base support 1 by means of a pivotal axis 8 that extends transversely relative to the longitudinal direction 7 of the chair. The pivotal axis 8, which defines the position of the pivotal point of the backrest, in this case, when viewed in the longitudinal direction 7 of the chair, is provided behind the cone accommodating means 2 in the lower region of the base support 1.

An entrainment means 9 in the form of a ball end is located on the backrest support 4 at a projection of the bearer 5 that forms the front end of the backrest support 4. The entrainment means 9, in this case, in the initial position represented in FIG. 1, is situated almost above the pivotal axis 8. When viewed in the longitudinal direction 7 of the chair, the entrainment means 9 can be slightly inclined backward in relation to the vertical. The entrainment means 9 is placed in an accommodating opening 12, which is provided on the underside 11 of the seat support 3 and is adapted to the shape of the entrainment means 9, in this case socket-shaped or bell-shaped, such that entrainment means 9 and accommodating opening 12 make up a kind of universal joint.

When the backrest carries out a pivoting movement backward in the pivoting direction 6, the seat support 3 performs an exclusively horizontal movement backward in the direction of displacement 13. In this case, the seat support 3, and consequently the seat 14 that is fixedly connected to the seat support 3, is entrained backward by the entrainment means 9, as is represented in FIG. 2. To this end, the seat support 3 is connected to the base support 1 by means of a linear guide, which is not shown in any detail.

In another embodiment of the invention, a seat depth adjustment is provided. In other words, the seat support 3 can be displaced in the longitudinal direction 7 of the chair forward or backward and locked in the desired position.

The seat depth adjustment, which is preferably actuatable in a manual manner by the user of the office chair, can be achieved, on the one hand, by the position of the accommodating opening 12 being modifiable in the longitudinal direction 7 of the chair by means of an adjusting device (not shown). As an alternative to this, a plurality of accommodating openings 12 can be provided located in the longitudinal direction 7 of the chair. Then, in which of the accommodating openings 12 the entrainment means 9 is placed can be adjusted by using an adjusting device.

For example, the position of the socket-shaped or bell-shaped accommodating opening 12 on the underside 11 of the seat support 3 can be varied by the accommodating opening 12 being located in an accommodating element 15, which has, on its top side 16 facing the seat support 3, a locking and/or clamping mechanism (not shown), by means of which the accommodating element 15 can be secured at different points on the underside 11 of the seat support 3 in the longitudinal direction 7 of the chair. For this purpose, the seat support 3 can be provided, for example, with a mounting rail (not shown) provided with locking and/or clamping elements for the accommodating element 15.

In another embodiment of the invention, the entrainment means 9 is not in the form of a ball end but rather is in the form of a pin. An accommodating opening 12 in the form of a tube that is provided on the underside 11 of the seat support 3 is used in a corresponding manner. In this case too, a seat depth adjustment can be effected, one of the two variants already described above preferably being used.

Figure 3:
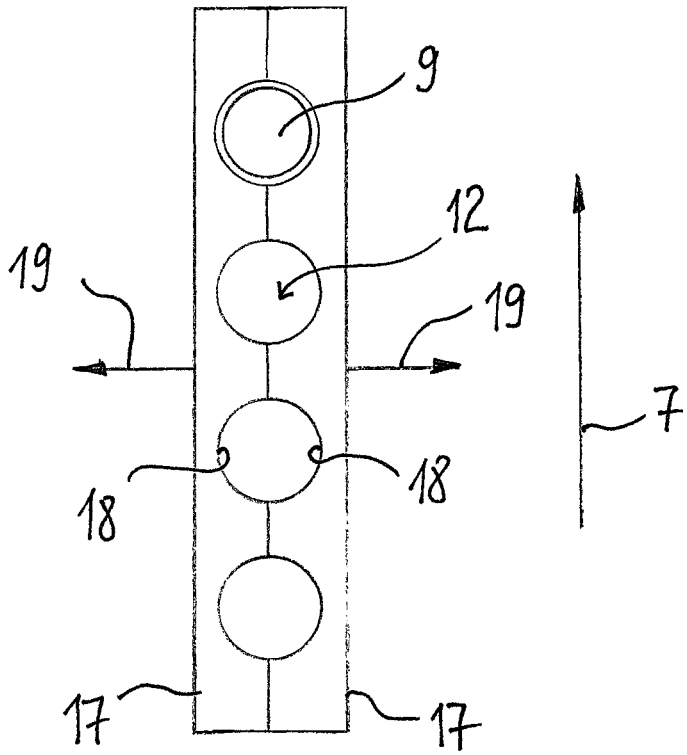
FIG. 3 shows a top view onto the underside of the seat support where a pin-shaped entrainment means is used.

FIG. 3 shows an embodiment with a pin-shaped entrainment means 9, where a plurality of tubular accommodating openings 12 is located in the longitudinal direction 7 of the chair. A total of four accommodating openings 12 are formed by two strips 17, each of which is provided with four semicircular recesses 18, the strips 17 abutting against each other in the closed state in such a manner that the recesses 18 form four circular accommodating tubes 12.

The pin-shaped entrainment means 9 is placed in the front accommodating opening 12 when viewed in the longitudinal direction 7 of the chair. By means of an adjusting device (not shown in any detail), which is operable, for example, by means of an actuating button that is located to the side of the seat support 3, the strips 17 are moved apart in the opening direction 19 for modifying the seat depth adjustment. This creates a groove between the strips 17, in which groove the pin-shaped entrainment means 9 can be displaced in the longitudinal direction 7 of the chair. By resetting the strips 17 into their closed initial position, the entrainment means 9 engages in another accommodating opening 12 and is once again locked in said opening.

The operative connection between entrainment means 9 and seat support 3 can also be produced in another manner, entrainment means 9 and seat support 3, however, preferably being interconnected in a direct manner. In other words, direct, immediate actuation of the seat support 3 is preferably effected by the entrainment means 9 without requiring complicated indirect structures, such as levers, etc., for this purpose.

Irrespective of its concrete shape, a distinguishing feature of the entrainment means 9 is that it also performs the pivotal movement of the backrest support 4 in a direct manner. The entrainment means 9, in this case, is preferably in the form of a component that is rigidly connected to the backrest support 4, such that its free end, which is directed away from the backrest support 4 and is placed in the accommodating opening 12, performs the identical cam path as the backrest support 4 itself. This preferably not only applies when there is just one indirect connection between entrainment means 9 and seat support 3, but in particular whenever entrainment means 9 and seat support 3 are interconnected in a direct manner.

In the case of the embodiments represented in FIGS. 1 and 2, the seat support 3 performs an exclusively horizontal movement. In other words, the inclination of the seat support 3, and consequently of the seat 14, remains unchanged. When the backrest pivots, a synchronous linear entrainment of the seat 14 backward is effected at a defined, not necessarily constant ratio to the backrest, however no lifting or lowering of the front or rear part of the seat support 3.

The costs for the production of such a mechanism with an exclusively horizontal displacement of the seat support 3 can be reduced over and above this, as a pivoting movement backward, due to the exclusively horizontal displacement of the seat 14, does not result in a displacement downward of the pivotal point of a user. Whereas in the case of conventional synchronizing mechanisms, the spring arrangements provided in the interior of the mechanism are realized for "restoring" both the backrest and the seat 14 into their initial position, as soon as the user pivots back into an upright position, the spring arrangement used in the mechanism according to the invention (not represented) is only required to "restore" the backrest. As, consequently, on account of the lack of displacement of the pivotal point, smaller forces are necessary in total for straightening up, the spring arrangement used clearly only needs smaller dimensioned spring elements.

Figure 4:
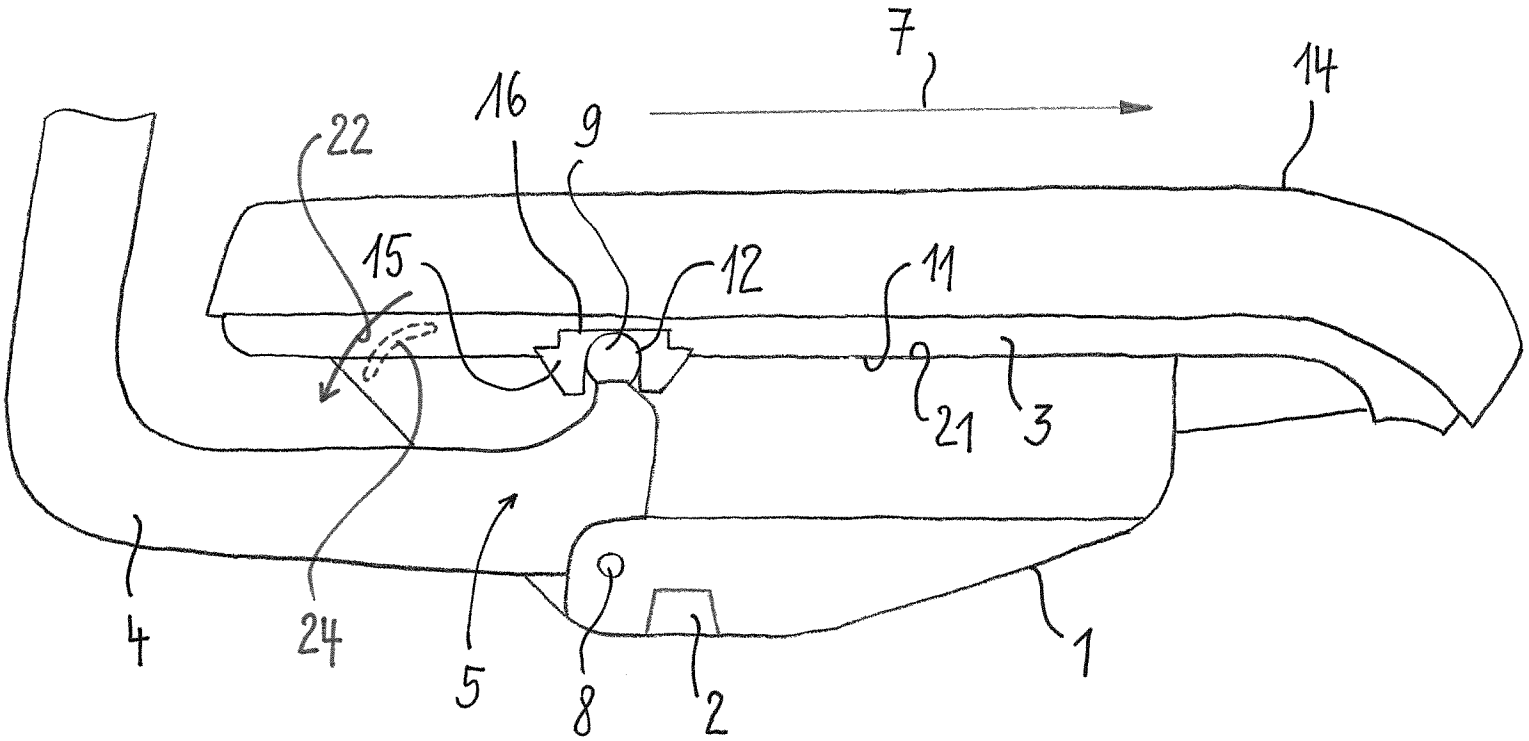
FIG. 4 shows a side view of another synchronizing mechanism in the initial position.
Figure 5:
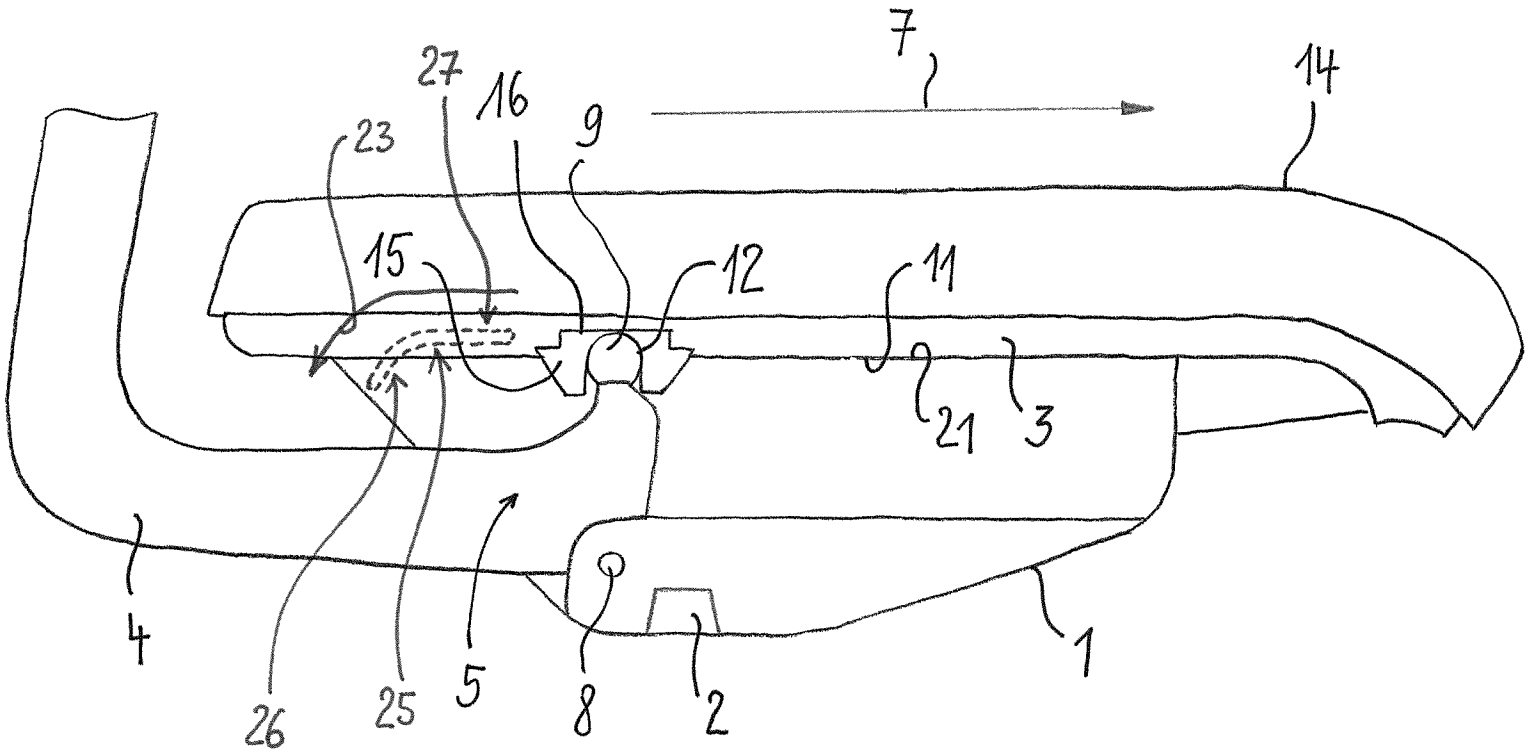
FIG. 5 shows a side view of yet another synchronizing mechanism in the initial position.

In other embodiments of the invention, as shown in FIGS. 4 and 5, when the backrest carries out a pivoting movement backward, the seat support 3 performs a non-horizontal movement 22 or a not exclusively horizontal movement 23 backward. In this case, the seat support 3 is connected to the base support 1 by means of a guide 24, 25 that is at least partially non-linear.

In the case of a non-horizontal movement 22 backward of the seat support 3, an inclined or arcuate guide path 24 is provided on the top side 21 of the base support 1, on which guide path 24 the seat support 3 pulled by the entrainment means 9 is moved backward and downward, see FIG. 4, or, depending on the design of the path, backward and upward. The guide path 24, in this case, can have a continuous curvature. However, the guide path 25 can also be in two parts, for example, and have a rear curved element 26, when viewed in the longitudinal direction 7 of the chair, and a front linear path element 27, when viewed in the longitudinal direction 7 of the chair, such that a not exclusively horizontal movement of the seat support 3 can be effected, see FIG. 5. This is advantageous, for example, if the seat 14 or the seat support 3 used is in two pieces, in particular in such a manner that, a rear seat element, when viewed in the longitudinal direction 7 of the chair, is connected in a pivotable manner to a front seat element, when viewed in the longitudinal direction 7 of the chair. In this case, the guide path can be developed, for example, in such a manner that when the backrest pivots backward, the rear seat element performs a movement back and down on a curved cam path, whilst the front seat element performs a simply horizontal displacement backward.

By developing the guide path 24, 25 in an arbitrary manner to define the pulling movement of the seat support 3 backward, it is possible to realize countless movement sequences, which means that the synchronizing mechanism according to the invention can be used for a multitude of applications.

All the features represented in the description, the following claims and the drawing can be essential to the inventive step either individually or in arbitrary combination with each other.

List of References

1 Base support
2 Cone accommodating means
3 Seat support
4 Backrest support
5 Bearer
6 Pivoting direction
7 Longitudinal direction of the chair
8 Pivotal axis
9 Entrainment means
10 (free)
11 Underside
12 Accommodating opening
13 Direction of displacement
14 Seat
15 Accommodating element
16 Top side
17 Strip
18 Recess
19 Direction of opening
20 (free)
21 Top side
22 non-horizontal backward movement
23 not exclusively horizontal backward movement
24 non-linear guide
25 partially non-linear guide
26 rear curved element
27 front linear element

The invention claimed is:

1. A synchronizing mechanism for a correlated movement of a seat and a backrest of an office chair, the mechanism comprising:

a base support to be mounted on a chair column;

a seat support for supporting a seat of the office chair;

a backrest support connected to said base support and pivotable about a transverse axis;

said backrest support including an entrainment device in operative connection with said seat support such that, when the backrest carries out a pivoting movement backward, said seat support also performs a movement backward;

said seat support having an accommodating opening formed on an underside thereof adapted to a shape of said entrainment device, and said entrainment device being placed in said accommodating opening;

an adjusting device functional for modifying a position of said accommodating opening in a longitudinal direction of the chair; and an at least partially non-linear guide path connecting said seat support to said base support and when the backrest carries out the pivoting movement backward, said seat support performs a non-horizontal or not exclusively horizontal movement backward.

2. The synchronizing mechanism according to claim 1, wherein said entrainment device is in directed engagement with said seat support.

3. The synchronizing mechanism according to claim 1, wherein said entrainment device is in the form of a pin and said accommodating opening is in the form of accommodating tubes.

4. The synchronizing mechanism according to claim 1, wherein the non-linear guide path has two parts, which include a rear curved element and a front linear element when viewed in a longitudinal direction of the chair.

5. A synchronizing mechanism for a correlated movement of a seat and a backrest of an office chair, the mechanism comprising:

a base support to be mounted on a chair column;

a seat support for supporting a seat of the office chair;

a backrest support connected to said base support and pivotable about a transverse axis;

an entrainment device in operative connection with said seat support such that, when the backrest carries out a pivoting movement backward, said seat support also performs a movement backward; and said seat support having an accommodating opening formed on an underside thereof adapted to a shape of said entrainment device, and said entrainment device being placed in said accommodating opening, said entrainment device being in the form of a ball end and said accommodating opening being in the form of an accommodating socket or bell.

6. A synchronizing mechanism for a correlated movement of a seat and a backrest of an office chair, the mechanism comprising:

a base support to be mounted on a chair column;

a seat support for supporting a seat of the office chair;

a backrest support connected to said base support and pivotable about a transverse axis;

an entrainment device in operative connection with said seat support such that, when the backrest carries out a pivoting movement backward, said seat support also performs a movement backward;

said seat support having an accommodating opening formed on an underside thereof adapted to a shape of said entrainment device, and said entrainment device being placed in said accommodating opening; and an adjusting device functional to modify a position of said accommodating opening in a longitudinal direction of the chair;

said accommodating opening being one of a plurality of accommodating openings located in the longitudinal direction of the chair, and said accommodating openings for placement of said entrainment device being selectable by way of said adjusting device.

* * * * *